United States Patent [19]

Reed et al.

[11] Patent Number: 4,843,229

[45] Date of Patent: Jun. 27, 1989

[54] HIGH LIGHT LEVEL CUTOFF APPARATUS FOR USE WITH NIGHT VISION DEVICES

[75] Inventors: Joseph Reed, Stamford, Conn.; Joseph N. Caserta, Roanoke, Va.

[73] Assignee: ITT Electro Optical Products, A Division of ITT Corporation, Roanoke, Va.

[21] Appl. No.: 127,869

[22] Filed: Dec. 2, 1987

[51] Int. Cl.[4] ..... H01J 31/50; H01J 40/14

[52] U.S. Cl. ..... 250/213 VT; 315/241 P

[58] Field of Search ..... 250/312 VT; 315/241 P

[56] References Cited

U.S. PATENT DOCUMENTS 4,398,127 8/1983 Bahn et al. ..... 315/241 P 4,755,725 7/1988 Kastendieck et al. ..... 250/213 VT

*Primary Examiner*—David C. Nelms

*Assistant Examiner*—William L. Oen

*Attorney, Agent, or Firm*—Thomas N. Twomey; Mary C. Werner

[57] ABSTRACT

There is disclosed a high light level cutoff apparatus for use with night vision devices. The apparatus employs a digital method of timing implemented by a divider counter responsive to a crystal controlled input frequency which essentially controls a latch to produce an automatic shutoff of a night vision device during high light ambient conditions which conditions would undesirably reduce the effective life of such a night vision device. The circuitry disclosed utilizes a digital method of clocking and employs the latching relay as indicated which is operated by the digital counter. The circuitry provides a feed back from the latching relay which resets the night vision system so that it will re-operate if a transient accidentally serves to operate the goggles while the light level is in a high state. The circuitry provides a precise timing level via the counter which can be selected to provide extended time out periods from milliseconds to at least several minutes, circumventing many of the disadvantages of prior art devices.

20 Claims, 2 Drawing Sheets

HIGH LIGHT LEVEL CUTOFF APPARATUS FOR USE WITH NIGHT VISION DEVICES

BACKGROUND OF INVENTION

This invention relates to night vision devices and, more particularly, to a high light level cutoff apparatus which can be used to protect a night vision device during high light levels.

As is well known, the term night vision devices include direct view systems employing image intensification. Such systems have various uses but, in general, enable night time vision by responding to low level radiation which is present at night to enable a user to visually perceive a scene or object in the nighttime or in extremely dark environments.

Essentially, night vision devices employ an image intensifier or similar tube. The function of the image intensifier is to multiply the amount of incident light received by it to produce a greater signal for application either to a camera or directly to the eyes of a viewer. As such, these devices have both industrial and military application. An example of early uses of such devices can be had by reference to a text entitled "Photoelectricity And Its Applications" published in 1949 by John Wiley & Sons. Chapter 18 entitled "Light Beam Signaling And Infrared Detection" shows examples of early night vision devices such as the Sniperscope and Snooperscope. Such devices are employed by the military, for example, to enable troops to perceive the enemy at night. In any event, the chapter further discusses various peace time uses.

The development of such devices has followed the strides made in the electronic technologies. The apparatus, as presently employed for night vision, are extremely small and compact. Hence, various companies, such as the assignee herein, produce a number of devices as night vision goggles for enabling one to accomplish night viewing. The assignee herein supplies night vision goggles which are manufactured by IT&T Electro-Optical Products Division of Roanoke, Virginia. These devices enable one to perceive at night with great accuity and perception.

See, for example, U.S. Pat. No. 4,202,601 entitled "Training Aid For Use With Night Vision Apparatus" issued on May 13, 1980 to J. H. Burbo, et al. and assigned to the assignee herein. The patent gives a general description of various night vision devices and other uses and structures.

A most popular device is referred to as night vision goggles. These are portable devices which are powered by small batteries. A night vision goggle is intended to amplify light from a very poorly lit scene so the person needing to see in the dark, as indicated above, can observe the scene clearly using only ambient light, such as starlight, moonlight and so on. These goggles, however, can be inadvertently exposed for long periods of time to bright light while the battery power is still on. This drains the batteries rapidly and also decreases the life of the light amplifying tubes or image intensifier devices.

It is the purpose of a high level cutoff device or switch, which exists in the prior art, to sense the presence of high light levels or light intensity and to switch off the battery power during this condition, thus conserving both the battery and the tube life. It is also noted that there can be flashes of light even in a very dark scene and it is necessary to have the cutoff device operate only when exposed to a high light level for a reasonably long period of time, for example minutes, as compared to seconds. Accordingly, existing devices are equipped with a timer which times out when the high light level is sensed. The existing state of the art incorporates circuitry which serves to provide cutoff for such night vision devices during high light intensities. Such circuits incorporate analog circuitry and are comprised of a combination of specially fabricated integrated circuit chips and standard electronic devices.

In any event, there are specific problems associated with the prior art devices. Such disadvantages will be explained in greater detail in regard to FIG. 1 of the specification.

It is an object of the present invention to provide an accurate, inexpensive and reliable high light level cutoff device which eliminates many of the problems existing in prior art devices as to be described.

SUMMARY OF THE INVENTION

In a night vision device of the type employing image intensification circuitry means between an input and output port and including a high light level cutoff apparatus for removing power applied to said image intensification circuitry during a high light intensity condition which persists for a given period during a low light use, said cutoff apparatus including a switchable impedance device having a control electrode, said impedance in series with said image intensification circuitry to provide a high impedance for said given period indicative of said high light level in a first mode to effectively remove power from said circuitry and a low impedance in a second mode to allow said night vision device to operate, said light intensity being monitored by a light sensor means for providing an output signal according to the intensity of received light, means for comparing said output signal with a reference signal to provide a control signal indicative of said high light level for a given period to operate said impedance in one of said first or second modes, the improvement therewith of apparatus for controlling the operation of said switchable impedance to assure reliable operation of the same in said first and second modes comprising high voltage supply means including a stable oscillator means for providing a stable frequency signal at an output, voltage multiplier means responsive to said frequency for providing a high voltage bias signal for application to said control electrode of said switchable impedance device, latching means coupled to said control electrode and operative in a first state to place said impedance in said first mode and in a second state to place said impedance in said second mode, counting means having an output coupled to said latching means and having input means coupled to said output of said stable oscillator means and said means for comparing to provide at an output a control signal indicative of a given time interval of said high light condition and specified according to said stable output frequency to operate said latching means in said first mode when said counting means provides said control signal indicative of counting a predetermined number of said stable frequency cycles.

BRIEF DESCRIPTIONS OF FIGURES

DETAILED DESCRIPTION OF INVENTION

Figure 1:
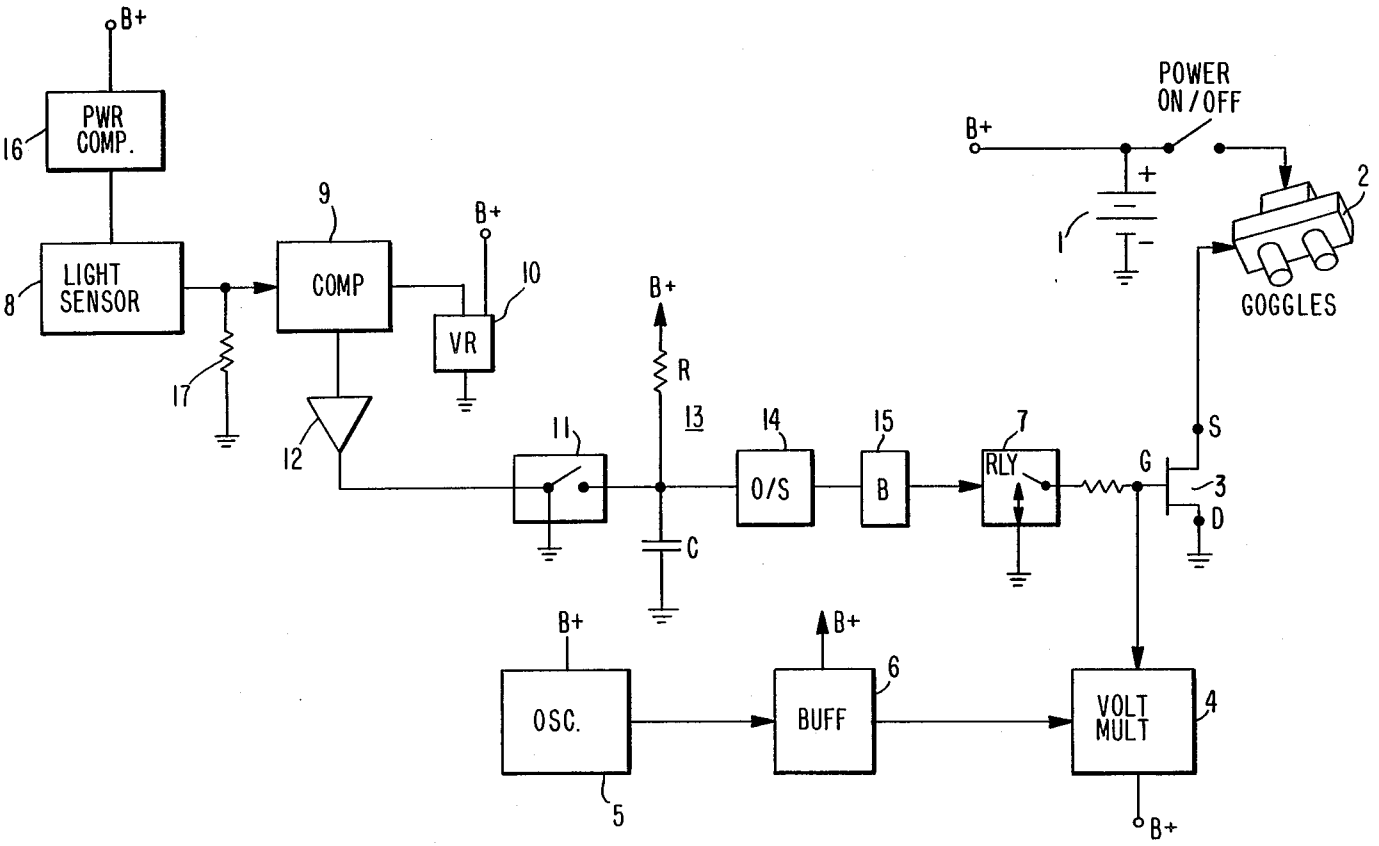
FIG. 1 PRIOR ART
FIG. 1 is a detailed block diagram of a prior art high light level cutoff device.

Referring to FIG. 1 there is shown a detailed block diagram of a prior art high level cutoff apparatus which, for example, is of the type that has been employed in commercially available devices. As one can ascertain from FIG. 1, there is shown a battery 1. The battery 1 is the sole source which operates the goggle system 2 and is also used to power the high level light switch of the prior art. As one can ascertain, and as will be further clarified, it is therefore necessary that the power drain on the battery 1, from the high level switch, be very low to provide greater life and more reliable use. Provisions are made in the prior art to switch off the high light level device when not in use. In that case the switch transistor 3 must be bypassed by a contact of the on/off switch when the unit is in the off position so that the goggles can operate independently, without the protection afforded by the high light level device.

Referring to FIG. 1, the prior art device operates as follows. A free running oscillator 5, which may be an astable multivibrator or any oscillator configuration, is used to generate an AC waveform at a given frequency which is rectified in a voltage multiplier 4. Essentially, the oscillator 5 is coupled via a buffer amplifier 6 to the voltage multiplier 4. The voltage multiplier is a conventional diode bridge array of the type employed to develop a high voltage at the output of the voltage multiplier. This voltage is used to bias the gate electrode (E) or control electrode of the switch transistor 3. The switch transistor 3 may be a high voltage FET device having a source (S) and drain (D) electrode and provides a ground return for the battery supply as applied to the night vision goggle circuitry in module 2. The resulting high voltage from multiplier 4 is added to the battery voltage (B+) and applied to the gate electrode of the FET switch transistor 3. There is also coupled to the gate electrode of the FET transistor 3 a latching relay 7. The latching relay 7 may be a typical semiconductor circuit and is shown in the figure in schematic form. If the latching relay 7 is not in the closed position, the voltage at the gate electrode turns the switch transistor on. This high voltage is needed to assure that the switch transistor 3 presents a very low resistance in the ground return of the goggle circuitry (about 0.1 ohms) so that very low power is dissipated in the switch transistor 3 during operation. The goggles 2, therefore, operate when the switch transistor 3 is in the ON or conducting mode. If the light level sensed by the light variable resistor or a light sensor 8 is low, the voltage presented to the comparator 9 on one input enables the comparator to provide a low output signal. The comparator is biased by means of a typical voltage reference source 10 which operates as a reference level for the comparator. Comparators as 9 are well known circuits and many examples exist in the prior art. There is shown a biasing resistor 17 which, essentially, is coupled to the other input of the comparator 9 and is used to determine the voltage from the light sensor 8 which will activate the comparator, as will be explained.

Also shown coupled to the light sensor 8 is a biasing source, or a power conditioner circuit 16. The power conditioner 16 is, essentially, a constant current source which is used in conjunction with the light sensor 8 and which provides a constant current to the same. Such power conditioning circuits 16 are well known. The light sensor 8, of course, may be a suitable photoresponsive diode photoresistor, or photocell or other conventional device which produces an output according to light intensity impinging thereon. Such devices, of course, are well known in the prior art.

Coupled to the output of the comparator 9 is a buffer 12 which is coupled via an switch 11 to an RC network 13. The RC tuning network 13 is, therefore, inactive when the output of the comparator is low (switch 11 is closed) and the voltage presented to the one shot, or monostable multivibrator 14, is close to ground potential. In any event, during nighttime operation, when the light level, as sensed by the light sensor 8, reaches a value such that the voltage presented to the comparator 9, from the light sensor 8, is lower than that presented by the voltage reference 10 the comparator operates the buffer 12 which then operates switch 11, opening it. The switch 11 may be an FET device or a suitable semiconductor switch, which is also a typical and commercially available component.

At this point the capacitor C, in the timing network 13, starts to charge via resistor R. At some time determined by the RC values of the network 13, the voltage presented to the one shot pulse generator 14 exceeds the preset level of the device and a pulse is sent out to the buffer 15. The buffer 15 then operates the solid state latching relay 7 which grounds the gate electrode of the switching transistor 3. Thus, as a result, the switch transistor 3 reverts to a high impedance state and, hence, the goggles and associated circuitry are shut off and rendered inoperative.

Thus, based on the above description, one can see that the apparatus depicted in FIG. 1 and as indicative of the prior art does function to render the goggles inoperative during a high light condition when the goggles are conventionally employed for nighttime use.

There are several areas where the prior art circuitry of FIG. 1 is deficient. First, the timing required is between one or two minutes and, in fact, could be longer. Consequently, the R and C values associated with network 13 approach the realm of impracticality because they must be so large, and the quality of the capacitor must be so great in regard to extremely low leakage, that such components are extremely difficult to obtain and are therefore extremely expensive. In any event, due to the actual values required, the components are not available and, hence, one must compromise the design.

The impedance levels associated with the circuitry are so large as to make both the design and manufacture very difficult and costly. In fact this is the actual case. The design of a high level prior art cutoff switch constitutes a very significant factor in the cost of a pair of night vision goggles.

Another extremely detrimental factor is that the timing is highly variable and cannot be adjusted easily. This is, of course, due to the lack of the precision components necessary to provide the requisite timing. In order to overcome this variability, calibration is accomplished by adjusting the calibration resistor 17 during manufacture so that switch 11 operates when the light level reaches the specified level. This is extremely difficult because of the tolerances, drift and temperature sensitivity of the power supply or constant current source 16, the tolerances and characteristics of the light sensor 8, the tolerances associated with conventional comparators, such as comparator 9 and the drift and temperature stability of the buffer 12.

There is the further problem that in the event that the latching relay 7 opens, due to any cause such as transients or RF interference, while the light level is still high, there is absolutely no way to render the goggles inoperative again and the purpose of the entire circuit, as shown in FIG. 1, is defeated. In any event, if the light level falls below the predetermined value then switch 11 is closed and the capacitor C associated with network 13 is drained so that the entire timing circuit is reset. However, the switch or latch 7 is not reset unless the entire system is turned off and then on again manually. This may or may not be desirable in field operation because the goggles will not operate unless this is done. Hence, this requires special training and special instructions to the users of such goggles in the event that this occurs.

As one can ascertain, the above-noted problems substantially increase the manufacturing costs of the prior art device and lead to expensive setup time, calibration time and present problems during field use.

Figure 2:
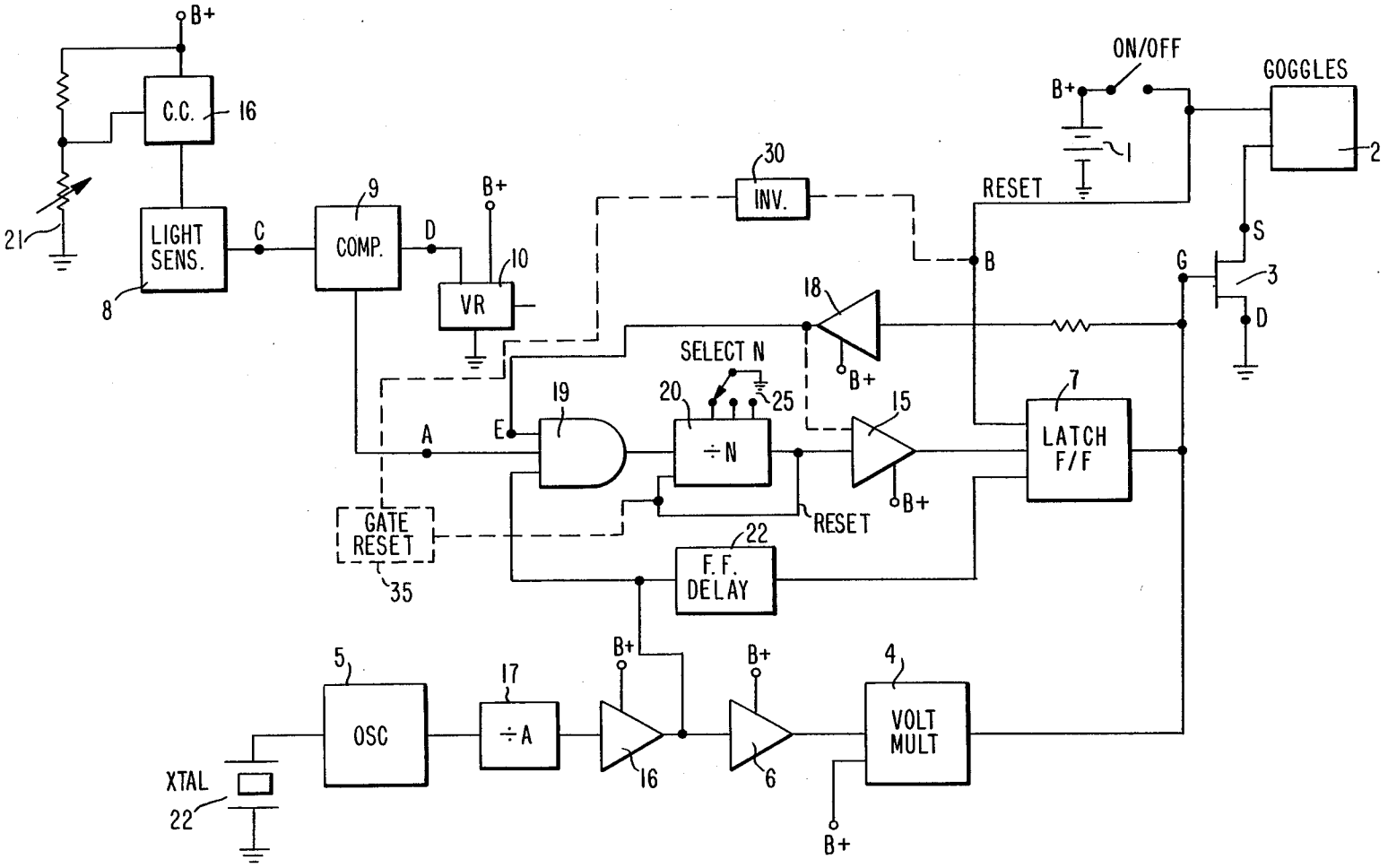
FIG. 2 is a detailed block diagram of a high light level cutoff apparatus according to this invention.

Referring to FIG. 2 there is shown an improved version of the above-noted circuitry in FIG. 1. It is immediately noted that in FIG. 2 the same reference numerals have been retained to indicate similarly functioning parts. As one can ascertain from FIG. 2, the goggles have been represented by the reference numeral 2, as in FIG. 1, but in a block diagram rendition. The switching transistor 3 is designated by the same reference numerals, and so on.

The circuitry of FIG. 2 is utilized to overcome the above-noted deficiencies, as will be further explained. The apparatus of FIG. 2 employs a digital method of timing. The apparatus to be described also uses a digital method of clocking and operating the latching relay 7. In addition, it provides a feedback from the latching relay 7 which resets the system so that it will re-operate if a transient accidentally turns the goggles on while the light level is still high. In addition, the circuit provides reasonably precise timing which can be accommodated to provide time out periods from milliseconds to at least several minutes. The circuit further provides and enables much simpler calibration therefore saving excessive setup time during the manufacturing and checkout process. Hence, referring to FIG. 2 there is shown a complete diagram of the improved system according to this invention.

In this improved system the oscillator 5 is controlled by a crystal 22 so that the frequency is held to close tolerances. Crystal controlled oscillators, such as oscillator 5, are well known and used in many precise devices, such as digital clocks, watches and so on. The circuit configurations are common and very inexpensive due to the widespread use. The output of the clock or oscillator 5 is then divided by a value A by means of a conventional binary divider 17 which is also a conventional integrated circuit. The output of the divider 17, which may be, for example, a gated counter consisting of conventional integrated circuit flip flops, is coupled to buffer 16, which presents the divided clock frequency to the input of the voltage multiplier 4 which, essentially, operates in the same exact manner as the voltage multiplier in FIG. 1. It is of course understood that in certain applications where stabilities in the neighborhood of 1 percent or so are adequate, one can employ an RC oscillator such as an astable multivibrator or other RC configuration. It is noted that the oscillator is used both for voltage multiplication and as the timing source.

The frequency at the output of the oscillator 5 is thus reduced to a value by the operation of the divider 17 so that it is compatible with the operation of the typical voltage multiplier 14. This frequency value desirably is about 3 to 10 khz. The resultant output frequency from the divider 17 is then amplified by the buffers 6 and 16 to provide adequate drive to the voltage multiplier 14 and the output of the buffer 16 is also coupled to one input of an AND gate 19.

As seen in FIG. 2, the output voltage from the voltage multiplier 4 is applied to the gate electrode of the FET switch transistor 3 after adding it to the battery voltage (B+) which is derived from the battery source designated by reference numeral 1. The resulting voltage at the gate electrode will vary from about 6 to 9 volts, depending upon the battery voltage and the age of the battery. The battery voltage 1 may vary from 3 volts (fresh) to 2 volts (almost the end of life).

As one can ascertain, when the goggles have been turned on with the power on/off switch, the latching relay 7, which again is a typical semiconductor relay configuration, is reset so that it is in the open position as, for example, shown in FIG. 1. In this condition the switch transistor 3 is fully on or conducting. The switch transistor 3 then presents a low resistance in series to ground for the goggle circuitry 2 and the goggles now operate in typical nighttime conditions. The above, of course, assumes that the light level presented to the light sensing resistor or sensor 8 is low so that the cutoff circuitry of FIG. 2 has not been operated.

In any event, when the light level presented to the light sensing resistor 8 is low, the sensing resistive value is high. This is conventional in regard to most photoresistor devices and the effect is well known. Consequently, the voltage presented at the point C, which is the output of the light sensor, is higher than the voltage at point D, which is the voltage reference input (VR), to the comparator 9 and, hence, under these conditions there is no output from comparator 9. When the light level presented by the light sensor rises, the resistance of the sensor decreases and the current from the constant current source 16 produces a lower voltage at point C. The voltage at point D, which is derived from the reference source 10, which is a "band gap" type device, remains constant. When the voltage at point C falls below that of point D, there is an output from comparator 9 which therefore presents a different voltage level at point A. As one can ascertain from FIG. 2, the AND gate 19 has one input connected to the output of buffer 16, one input is connected to the output of the comparator 9 designated by A and one input (which is the third input), is connected to the output of a buffer 18. The input of buffer 18 is connected via a resistor to the gate electrode of the switch transistor 3. Hence, the voltage at the output of buffer 18, having an input connected to the gate of the switch transistor 3, specifies whether the latching relay 7 is in the closed or opened state. Thus, during the above-described operation, the voltage at point E of the AND gate 19 is also high. In this event, the oscillator output frequency, as divided by the divider 17 and as applied to buffer 16, is propagated by the AND gate 19 to the input of a divide by N counter 20. During this condition the frequency from oscillator 5, as divided by divider 17 and applied via buffer 16, is presented to the counter 20. This counter is set to divide by a large number N so that a period of time, up to 5 minutes, elapses before a pulse output is fed to the buffer amplifier 15 connected to the output of the counter 20. Such counters 20 are well known and as seen can be associated with a selector switch 25 to select the division factor N and hence the interval desired. It is of course understood that the counter can be preset during manufacture and, hence, the selector switch or means can be eliminated.

The output of buffer 15 operates the latching flip flop or latching relay 7 upon the next positive going clock pulse. The buffer amplifier 15 may be substituted by a flip flop so that the pulse output from counter 20 is held until the next clock pulse. If required, a reset pulse may be obtained for this flip flop from buffer 18, as shown by the dashed line of FIG. 2. The result is that latching flip flop 7 closes, thus grounding the gate electrode of the switch transistor 3. As a result, the switch transistor 3 shuts off thus presenting a high impedance in series to ground for the goggle circuits 2 and the goggles are thereby shut off or rendered inoperative. Simultaneously, the AND gate 19 is opened, as is the buffer 15, and no further action takes place. Alternatively, one can disable the oscillator 5 in order to save power. Disablement of the oscillator 5 can be achieved by many well known techniques as opening the feed back path, ground return path or the bias supply. Should the latching relay 7 open for any reason, due to transients and so on, the buffer 18 re-enables the AND gate 19 and the counter 20 starts to operate again providing that the light level as detected by the light sensing resistor 8 is still high enough. This will repeat the action and operate the latching relay 7 once more, thus shutting the goggles off in another minute or so, depending on the division factor associated with counter 20. It is seen that the high voltage from multiplier 4 has been removed by the latch 7. Thus, some milliseconds will elapse before switch 3 is again engaged by the oscillator re-operating if latch 7 opens in the case where the oscillator is disabled. The time will be again set by the number N to which the counter 20 has been set at the factory, or one can buy commercially available integrated circuit dividers with predetermined selectable division factors or selectable according to switch 25.

If desired, an inverter 30 may be inserted between points A and B, where point B is the output of the on/-off switch, as shown. The inverter 30 assures that if the light level again returns to a low value the latching relay 7 is reset and the goggles automatically turn on. Otherwise, operating the power on/off switch will send an enable pulse to the latching relay 7 resetting it manually so that the goggles may be used in a dark situation. As indicated, counter 20 may be associated with selector switch 25 to enable a user to set the number N according to actual field conditions. Hence, counter 20 can employ the selector switch 25 associated therewith whereby the selector switch 25 will enable one to select the above-noted timing situation to any particular time, say for one minute, two minutes, five minutes or less or more, depending on the desires of the operator in the field.

The point of operation with respect to the light level may be adjusted by controlling the current from the constant current source 16. This is done by the trimming resistor 21 so that the FET current can be varied as associated with the constant current supply 16. As one will further understand, simple circuitry 31 can be included so that point A, or the output of the comparator, is directly coupled to the counter 20 so as to reset that counter to account for a momentary darkening of the input to the light sensing resistor 8. Thus, the circuitry 31 may be a one shot which triggers when comparator 9 goes back to its first state due to a momentary or transient darkening of the environment or any analogous effect to the light sensor 8. This assures that the counter 20 will again commence its timing from the beginning if the transient then disappears. This is another advantage of the circuit and can be implemented in other ways, as one skilled in the art will ascertain.

The circuitry can be implemented advantageously by CMOS technology, as that used for conventional digital timing devices such as, for example, digital watches. This assures low power drain on the battery 1 and, hence, prolong battery life. This, of course, will absolutely prevent draining the battery when the circuit is not in use.

An on/off switch may also be inserted in the B+ lead, as shown in the figure, to shut the device off entirely when the goggles are stored for lengthy periods. The use of metal gate CMOS is preferred for all circuitry except, of course, for the switch transistor 3. Such circuitry is available from many sources and there are complete families of CMOS logic modules available in integrated circuit form.

The crystal employed in conjunction with the oscillator 5, as indicated above, can be the type used in digital watch circuitry to keep the costs extremely low. In regard to this, manufacturers, such as Texas Instruments and so on, supply crystal and oscillator 5 configurations in conjunction with dividers as 17 as IC modules which are employed in digital watches and are extremely inexpensive.

Thus, it is seen that there has been described an improved high light level apparatus which circumvents many of the prior art problems, as described above. In this manner the shutoff time of the apparatus, after the sensing of a high light level, may be accurately adjusted with a minimum of effort. The time out period, as indicated above, is accurately controlled by the digital counter using a crystal controlled frequency input which provides accurate timing under all types of variable environmental conditions, such as temperature, pressure, change in battery voltage, and so on.

The circuitry also provides means whereby unintentional turn on of the goggles, due to any transient circuit action, is overcome by reactivating the time out circuit so as to reactivate the shutoff action after a suitable time delay. The timing frequency may be used as a clock so that all the flip flops, latches, gates, buffers and so on, are suitably timed and delayed so as to prevent inadvertent race conditions. The circuitry employed, such as CMOS technology, reduces the power consumption of this device, as compared to prior art devices, and therefore the power consumption of the high light level cutoff switch of this invention is substantially reduced so as to prevent excessive battery drain.

What is claimed is:

1. In a night vision device of the type employing image intensification circuitry means between an input and output port and including a high light level cutoff apparatus for removing power applied to said image intensification circuitry during a high light intensity condition which persists for a given period during a low light use, said cutoff apparatus including a switchable impedance device having a control electrode, said impedance in series with said image intensification circuitry to provide a high impedance for said given period indicative of said high light level in a first mode to effectively remove power from said circuitry and a low impedance in a second mode to allow said night vision device to operate, said light intensity being monitored by a light sensor means for providing an output signal according to the intensity of received light, means for comparing said output signal with a reference signal to provide a control signal indicative of said high light level for a given period to operate said impedance in one of said first or second modes, the improvement therewith of apparatus for controlling the operation of said switchable impedance to assure reliable operation of the same in said first and second modes comprising:

high voltage supply means including a stable oscillator means for providing a stable frequency signal at an output, voltage multiplier means responsive to said frequency for providing a high voltage bias signal for application to said control electrode of said switchable impedance device, latching means coupled to said control electrode and operative in a first state to place said impedance in said first mode and in a second state to place said impedance in said second mode, counting means having an output coupled to said latching means and having input means coupled to said output of said stable oscillator means and said means for comparing to provide at an output a control signal indicative of a given time interval of said high light condition and specified according to said stable output frequency to operate said latching means in said first mode when said counting means provides said control signal indicative of counting a predetermined number of said stable frequency cycles.

2. The apparatus according to claim 1 wherein said digital counting means is a binary counter capable of dividing said stable frequency by a factor N, where N is a positive integer greater than 1.

3. The apparatus according to claim 1 wherein said switchable impedance device is a FET transistor having a source to drain electrode path in series with said image intensification circuitry and a gate control electrode coupled to the output of said latching means.

4. The apparatus according to claim 1 wherein said stable oscillator means is a crystal controlled oscillator for providing at an output said stable frequency signal and a divider coupled to said output for providing a divided stable frequency output for application to said voltage multiplier means.

5. The apparatus according to claim 1 wherein said voltage multiplier means includes rectifier means.

6. The apparatus according to claim 1 wherein said input means of said digital counting means is an AND gate having one input coupled to the output of said stable oscillator means and a second input coupled to the output of said means for comparing to provide at an output said stable frequency at least when said comparing means provides said control signal.

7. The apparatus according to claim 6 wherein said AND gate has a third input coupled to said control electrode of said switchable impedance device to provide said output when said switchable impedance is in said second mode whereby said counting means will operate only during said second mode.

8. The apparatus according to claim 1 wherein said light sensor means includes a light sensing resistor biased by a constant current source and means for adjusting said bias current.

9. The apparatus according to claim 1 wherein said means for comparing includes a comparator having a first input coupled to said light sensor means and a second threshold input coupled to a reference voltage source for providing an output when said light sensor means provides a given output value indicative of a predetermined light intensity.

10. The apparatus according to claim 9 further including means coupled between said output of said comparator and said latching means to enable said switchable impedance to be operated in said second mode when said light level returns to a valve lower than said high level.

11. The apparatus according to claim 1 further including selector means coupled to said counting means for selecting the number of stable frequency cycles counted before providing said control signal.

12. The apparatus according to claim 1 wherein said counting means is a digital counter implemented by CMOS logic circuitry.

13. The apparatus according to claim 1 further includes means coupled between the output of said means for comparing and said counting means to reset said counting means when said light sensor means provides a value indicative of a momentary darkness transient to thereafter enable said counting means to continue operation after said dark transient of a relatively small duration as compared to said given time interval.

14. The apparatus according to claim 1 wherein said night vision device is a night vision goggle device.

15. The apparatus according to claim 1 further including an on-off power switch coupled to a battery source and operative to couple said battery source to said high level cutoff circuit and said image intensification circuitry during said ON state of said switch and to open said coupling path during said OFF state.

16. The apparatus according to claim 1 wherein said latching means includes a latching flip-flop.

17. The apparatus according to claim 9 wherein said voltage reference source is a "band-gap" device.

18. The apparatus according to claim 4 wherein said divided stable frequency output for application to said voltage multiplier means is selected to be between 10 to 15 KHZ.

19. The apparatus according to claim 15 wherein said battery source provides an output potential between 2 to 3 volts.

20. The apparatus according to claim 11 wherein said selector means provides stable frequency counts selectable in given increments.

* * * * *